US012227881B2

(12) United States Patent
Hamada et al.

(10) Patent No.: US 12,227,881 B2
(45) Date of Patent: Feb. 18, 2025

(54) ULTRAFINE FIBERS AND LIQUID FIBER DISPERSION

(71) Applicant: Toray Industries, Inc., Tokyo (JP)

(72) Inventors: Kosuke Hamada, Shizuoka (JP); Norio Suzuki, Shizuoka (JP); Masato Masuda, Shizuoka (JP)

(73) Assignee: Toray Industries, Inc., Tokyo (JP)

( * ) Notice: Subject to any disclaimer, the term of this patent is extended or adjusted under 35 U.S.C. 154(b) by 703 days.

(21) Appl. No.: 17/293,392

(22) PCT Filed: Nov. 14, 2019

(86) PCT No.: PCT/JP2019/044779
§ 371 (c)(1),
(2) Date: May 12, 2021

(87) PCT Pub. No.: WO2020/101002
PCT Pub. Date: May 22, 2020

(65) Prior Publication Data

US 2022/0010461 A1 Jan. 13, 2022

(30) Foreign Application Priority Data

Nov. 16, 2018 (JP) ..... 2018-215287

(51) Int. Cl.
*D01F 8/14* (2006.01)
*D01D 5/08* (2006.01)

(52) U.S. Cl.
CPC ..... *D01F 8/14* (2013.01); *D01D 5/08* (2013.01); *D10B 2331/04* (2013.01)

(58) Field of Classification Search
CPC ..... D01F 8/14; D01D 5/08; D10B 2331/04
See application file for complete search history.

(56) References Cited

U.S. PATENT DOCUMENTS

2007/0196401 A1 8/2007 Naruse et al.
2009/0060961 A1 3/2009 Naruse et al.
2012/0251597 A1* 10/2012 Gupta ..... D01D 5/36 442/340
2014/0256203 A1* 9/2014 Mizota ..... D01D 5/34 442/304
2016/0177476 A1 6/2016 Ban et al.
2016/0333116 A1 11/2016 Nakatani et al.
(Continued)

FOREIGN PATENT DOCUMENTS

JP 2007-63714 3/2007
JP 2007-77563 3/2007
JP 2007-92235 4/2007
(Continued)

OTHER PUBLICATIONS

English translation of JP-5740877-B2 to Funakoshi et al. obatined from PE2E database (Year: 2015).*
(Continued)

*Primary Examiner* — Jeremy R Pierce
(74) *Attorney, Agent, or Firm* — DLA Piper LLP (US)

(57) ABSTRACT

An ultrafine fiber has a fiber diameter (D) of 100 to 5000 nm, a ratio (L/D) of a fiber length (L) to the fiber diameter (D) of 3000 to 6000, and a carboxyl terminal group amount of 40 eq/ton or more. At least a part of a surface layer of the ultrafine fiber may be formed of polyester.

6 Claims, 2 Drawing Sheets

(56) References Cited

U.S. PATENT DOCUMENTS

2020/0087417 A1 3/2020 Takaichi

FOREIGN PATENT DOCUMENTS

| | | | | |
|---|---|---|---|---|
| JP | 2007-107160 | | 4/2007 | |
| JP | 2010-59583 | | 3/2010 | |
| JP | 2011-021292 | A | 2/2011 | |
| JP | 5740877 | B2 * | 7/2015 | ..... D01D 4/06 |
| JP | 2018-162436 | | 10/2018 | |
| TW | I358484 | | 2/2012 | |
| TW | 201520388 | | 6/2015 | |
| TW | 201837080 | | 10/2018 | |
| WO | 2015/107995 | | 7/2015 | |

OTHER PUBLICATIONS

Notice of Submission of Opinion dated Dec. 15, 2023, of counterpart Korean Patent Application No. 10-2021-7014001, along with an English machine translation.

The Notice of Reasons for Refusal dated Nov. 24, 2021, of counterpart Japanese Patent Application No. 2019-571083, along with an English translation.

Taiwanese Office Action dated Sep. 26, 2023, of counterpart Taiwanese Patent Application No. 108141862, along with an English translation.

* cited by examiner

ULTRAFINE FIBERS AND LIQUID FIBER DISPERSION

TECHNICAL FIELD

This disclosure relates to ultrafine fibers having excellent uniform dispersibility in an aqueous medium and a fiber diameter of 100 to 5000 nm, and a fiber dispersion liquid in which the ultrafine fibers are uniformly dispersed in a medium.

BACKGROUND

At present, uses of fibers have been diversified not only for use as clothing but also for use as industrial materials, and required characteristics thereof have also been diversified. In response to such requirements, proposals related to a wide variety of fiber element techniques have been made.

Among such techniques, active research and technological development have been carried out to make fibers ultrafine since ultrafine fibers can take advantages of morphological characteristics inherent to fiber materials such as being thin and long, and can greatly affect characteristics when processed into fiber products.

A method of making a synthetic fiber ultrafine is selected from various methods depending on characteristics of a polymer and desired characteristics. A composite spinning method in which a hardly soluble component and an easily soluble component are made into a composite fiber having sea-island shaped cross section and then the easily soluble component is removed from the composite fiber to generate an ultrafine fiber formed of an island component is widely adopted industrially from the viewpoint of productivity and stability.

Ultrafine fibers obtained by the composite spinning method are mainly microfibers having fiber diameters of several μm, which are applied to wiping cloth and medium-performance filter media. With improvement of the technique, in recent years, it has become possible to manufacture nano-fibers having extreme fineness.

Since nano-fibers having a fiber diameter of several hundred nm have an increased specific surface area, which is a surface area per weight, and increased material flexibility, a so-called nano-size effect, which is a unique property that cannot be obtained with general-purpose fibers and microfibers, is exhibited. Such nano-size effect includes, for example, a gas adsorption effect (specific surface area effect) provided by the increase in the specific surface area, and a water absorption effect provided by fine micropores.

Since nano-fibers cannot be processed one by one, the nano-fibers are processed in various forms and subjected to high-order processing. Recently, attention has been focused on use of nano-fibers as sheet materials and fillers for molded products. As one form of a fiber material to achieve the sheet materials and the fillers, there is a fiber dispersion liquid in which nano-fibers cut to desired lengths are uniformly dispersed in a medium.

Such a fiber dispersion liquid has unique properties such as easy flowability, absorptivity, transparency, structural color development and, still further, thixotropy, and has thus attracted attention as a new high-performance material. Since nano-fibers have a large aspect ratio which is a ratio of a major axis (fiber length) to a minor axis (fiber diameter), the nano-fibers exhibit excellent thixotropy when formed into the fiber dispersion liquid. Therefore, a dispersion liquid state is easily maintained since the fiber dispersion liquid has high viscosity in a stationary state (under low shearing force). Meanwhile, the fiber dispersion liquid has excellent handleability since low viscosity is exhibited during processing of the fiber dispersion liquid (under high shearing force). Therefore, the fiber dispersion liquid can be expected to be used as filler for resin, paint, cosmetics and the like.

Further, studies have been made on development mainly in the field of industrial materials such as a high-performance filter medium, next-generation sound absorbing material capable of controlling a sound absorption wavelength, and a battery separator, by injecting the fiber dispersion liquid by a spray or the like to form a three-dimensional structure having a fine microporous structure, or by forming the fiber dispersion liquid into a sheet material by a wet-laid forming method or the like.

However, the fiber dispersion liquid having the above-described characteristics is obtained only when excellent dispersion of the nano-fibers in the medium is ensured. Typically, due to the increase in the specific surface area caused by nano-sizing, a cohesive force derived from an intermolecular force is overwhelmingly increased, and the nano-fibers are entangled with each other to form a fiber agglomerate. Therefore, it is difficult to obtain the fiber dispersion liquid in which nano-fibers are uniformly dispersed. Although such a phenomenon is also observed in general functional particles, the aspect ratio of nano-fibers is overwhelmingly higher than that of other functional particles, and thus uniform dispersion required for the fiber dispersion liquid is more difficult to be achieved.

A dispersant is applied to a surface of a nano-fiber to improve dispersibility. However, a sufficient dispersibility improving effect cannot be obtained by adding a small amount of the dispersant. On the other hand, although the dispersibility can be improved by adding a large amount of the dispersant, a decrease in handleability such as foaming may be caused during processing.

To solve such a problem, JP 2007-77563 A proposes a method of physically beating a nano-fiber agglomerate to improve dispersibility of nano-fibers in a medium. It is said that a fiber dispersion liquid in which each fiber is dispersed one by one can be obtained by using a mixer, a homogenizer, or a stirrer such as an ultrasonic stirrer to perform mechanical beating and defibration treatment on the fiber dispersion liquid.

JP 2007-107160 A proposes that a sea-island fiber having an island diameter (D) of 10 to 1000 nm is cut such that a ratio (L/D) of a fiber length (L) to the island diameter (D) is in a range of 100 to 2500 as a fiber form that is less likely to cause agglomeration.

In JP 2007-77563 A, the mechanical beating and the defibration treatment are required to obtain the fiber dispersion liquid, and a large stress thus acts on the fibers so that the fibers may be unnecessarily deteriorated depending on conditions due to embrittlement, breakage or the like of the fibers. In addition, since a fiber length is naturally shortened due to the breakage or the like, the obtained fiber dispersion liquid may not sufficiently exhibit characteristic effects such as thixotropy.

In JP 2007-107160 A, fiber entanglement can be reliably prevented, and a homogeneously dispersed fiber dispersion liquid can be achieved. However, the aspect ratio thereof is not sufficiently high compared to typical functional particles, and thus characteristics of the fiber dispersion liquid of ultrafine fibers are insufficient.

As described above, as for an ultrafine fiber having a fiber diameter of 100 to 5000 nm, there is no ultrafine fiber that is not unnecessarily deteriorated and has excellent uniform dispersibility in a medium regardless of a fiber form thereof.

It could therefore be helpful to provide an ultrafine fiber capable of ensuring excellent uniform dispersibility without causing agglomeration in an aqueous medium even when an aspect ratio is increased, and a fiber dispersion liquid obtained from the ultrafine fiber.

SUMMARY

We thus provide:

(1) An ultrafine fiber having a fiber diameter (D) of 100 to 5000 nm, a ratio (L/D) of a fiber length (L) to the fiber diameter (D) of 3000 to 6000, and a carboxyl terminal group amount of 40 eq/ton or more.

(2) The ultrafine fiber according to (1), in which at least a part of a surface layer of the ultrafine fiber is formed of polyester.

(3) The ultrafine fiber according to (1) or (2), in which the ultrafine fiber is a composite fiber formed of at least two kinds of polymers, and has a sheath-core structure or a side-by-side structure.

(4) The ultrafine fiber according to any one of (1) to (3), having a modification degree of 1.1 to 5.0 and a modification degree variation of 1.0% to 10.0%.

(5) The ultrafine fiber according to (1) or (2), formed of polyester.

(6) The ultrafine fiber according to any one of (1), (2), (4), and (5), in which the ultrafine fiber is formed of polyester, and has a modification degree of 1.1 to 5.0 and a modification degree variation of 1.0% to 10.0%.

(7) A method of manufacturing a fiber product, in which the ultrafine fiber according to any one of (1) to (6) is used.

(8) A fiber dispersion liquid in which ultrafine fibers having a fiber diameter of 100 to 5000 nm are dispersed in an aqueous medium, and the fiber dispersion liquid has a solid content concentration of 0.01% to 10% by weight and has a dispersion index of 20 or less, in which the dispersion index is measured by the method:

method of measuring the dispersion index: a fiber dispersion liquid is prepared such that the solid content concentration is 0.01% by weight with respect to a total amount of the fiber dispersion liquid, an image of the obtained fiber dispersion liquid at a magnification of 50 times is captured with a microscope under transmitted illumination, the image is converted into a monochrome image by using an image processing software, then a luminance histogram is formed with 256 grades, and a standard deviation obtained from the luminance histogram is used as the dispersion index.

(9) The fiber dispersion liquid according to (8), in which a dispersion stability index defined by the following formula is 0.70 or more:

$$\text{dispersion stability index}=H_0/H_1$$

in which $H_0$ is a height of a fiber dispersion liquid in a container after standing for 10 minutes, and $H_1$ is a dispersion height of the fiber dispersion liquid in the container after standing for 7 days.

(10) The fiber dispersion liquid according to (8) or (9), in which a thixotropy index (TI) defined by the following formula is 7.0 or more:

$$\text{thixotropy index } (TI)=\eta_6/\eta_{60}$$

in which $\eta_6$ is viscosity (at 25° C.) of a fiber dispersion liquid prepared such that solid content concentration is 0.5% by weight with respect to a total amount of the fiber dispersion liquid measured at a rotation speed of 6 rpm, and $\eta_{60}$ is viscosity (at 25° C.) of the fiber dispersion liquid measured at a rotation speed of 60 rpm.

(11) The fiber dispersion liquid according to any one of (8) to (10), in which the ultrafine fiber is formed of polyester.

(12) The fiber dispersion liquid according to any one of (8) to (11), including a dispersant.

Our ultrafine fiber has a fiber diameter of 100 to 5000 nm and exhibits excellent dispersibility even when the ratio (L/D) of the fiber length (L) to the fiber diameter (D) is 3000 to 6000 where dispersibility in a medium is significantly reduced.

Therefore, our ultrafine fiber can thoroughly exhibit adsorption performance and the like derived from a specific surface area of the ultrafine fiber due to extremely high dispersibility and dispersion stability in a medium, and has high processability due to excellent thixotropy.

That is, in the fiber dispersion liquid obtained from the ultrafine fiber, it is possible to stably perform processing such as application and spray injection of the fiber dispersion liquid even when a fiber form thereof is restricted, particularly when the aspect ratio is relatively high, and it is also possible to form an advanced fiber structure or the like in accordance with the processability. Therefore, when the fiber dispersion liquid is formed into a three-dimensional structure or a sheet material having complicated micropores or is added as a filler, a high toughness reinforcing effect can be obtained.

BRIEF DESCRIPTION OF THE DRAWINGS

FIGS. 2A and 2B are characteristic diagrams showing luminance histograms of a fiber dispersion liquid including the ultrafine fiber in which FIG. 2A is a luminance histogram of the fiber dispersion liquid in which fibers are uniformly dispersed, and FIG. 2B is a luminance histogram of the fiber dispersion liquid when fiber agglomerate is formed.

REFERENCE SIGNS LIST

Figure 1:
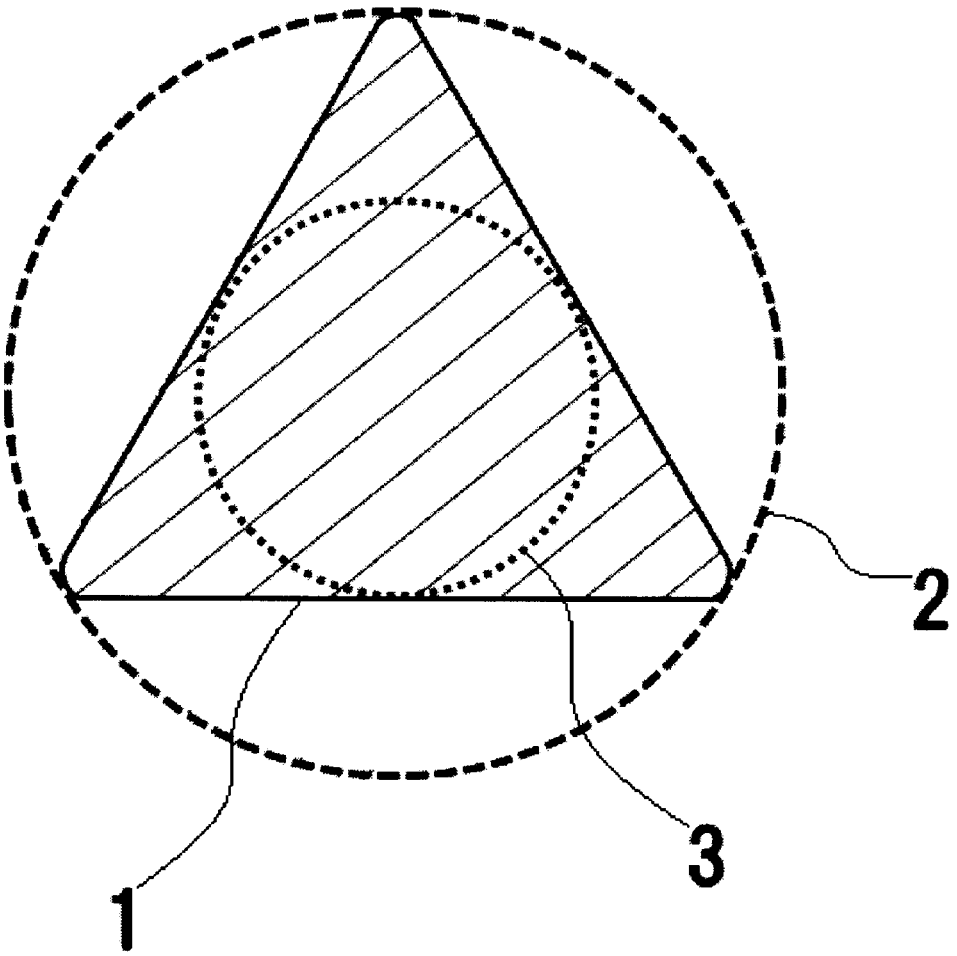
FIG. 1 is a schematic view of a cross section of an ultrafine fiber for illustrating a modification degree of the ultrafine fiber.

1: outer peripheral shape of ultrafine fiber
2: circumscribed circle
3: inscribed circle

DETAILED DESCRIPTION

Hereinafter, ultrafine fibers and liquid fiber dispersions will be described together with a preferred example.

A fiber dispersion liquid" may be simply referred to as a "dispersion liquid".

Our ultrafine fiber is required to have a fiber diameter (D) of 100 to 5000 nm, a ratio (L/D) of a fiber length (L) to the fiber diameter (D) of 3000 to 6000, and a carboxyl terminal group amount of 40 eq/ton or more.

The fiber diameter (D) herein is obtained as follows. That is, an image of a cross section of a fiber structure formed of ultrafine fibers is captured at a magnification at which 150 to 3000 ultrafine fibers can be observed with a scanning electron microscope (SEM) or a transmission electron microscope (TEM). Fiber diameters of 150 ultrafine fibers randomly extracted from each captured image of the fiber cross section are measured. The term "fiber diameter" refers to a diameter of a perfect circle circumscribing a cut surface which is a cross section taken in a direction perpendicular to a fiber axis based on a two-dimensionally captured image. A value of the fiber diameter is measured to a first decimal place in units of nm, and rounded off to the nearest integer. The above operation is performed on 10 images captured in the same manner, and a simple number average value of evaluation results of the 10 images is referred to as the fiber diameter (D).

We obtain a dispersion liquid produced by ultrafine fibers and suitable for a highly functional material which has particularly excellent filtration, adsorption and the like utilizing a specific surface area, and each ultrafine fiber needs to have a fiber diameter (D) of 100 to 5000 nm. In this range, even when mixed with materials, a specific surface area effect provided by the ultrafine fiber can be advantageously exhibited, and excellent performance can be expected to be exhibited.

From the viewpoint of increasing the specific surface area, although characteristics become more conspicuous as the fiber diameter becomes narrower, a lower limit of the fiber diameter is 100 nm from the viewpoint of handleability during a preparation process and a molding process of the dispersion liquid. It is preferable that the fiber diameter is 100 nm or more, since the ultrafine fiber is not broken and not unnecessarily deteriorated even when the dispersion liquid is stirred with a relatively high shearing force after the dispersion liquid is prepared if the fiber diameter is 100 nm or more.

Although good dispersibility can be ensured even if the fiber diameter exceeds 5000 nm, an upper limit of the fiber diameter is set to 5000 nm which is a range in which the specific surface area effect is advantageously exerted compared to a general fiber.

The handleability during the molding process and the like, the fiber diameter of the ultrafine fiber is preferably 100 to 1000 nm, which is a range in which the specific surface area effect of the ultrafine fiber is effectively exerted in mixing.

The ultrafine fiber needs to have a ratio (L/D) of the fiber length (L) to the fiber diameter (D) of 3000 to 6000.

The fiber length (L) herein can be obtained as follows.

A fiber dispersion liquid is prepared by dispersing in an aqueous medium such that solid content concentration is 0.01% by weight with respect to a total amount of the fiber dispersion liquid. The fiber dispersion liquid is dropped on a glass substrate and an image is captured with a microscope at a magnification at which 10 to 100 ultrafine fibers can be observed to measure their whole lengths. Fiber lengths of 10 ultrafine fibers randomly extracted from each captured image of the ultrafine fibers are measured. The term "fiber length" refers to a length of one fiber in fiber longitudinal direction based on a two-dimensionally captured image. The fiber length is measured to a second decimal place in units of mm, and is rounded off to the nearest integer. The above operation is performed on 10 images captured in the same manner, and a simple number average value of evaluation results of the 10 images is referred to as the fiber length (L).

Our ultrafine fiber can exhibit excellent dispersibility in a medium even when the ratio (L/D) of the fiber length (L) to the fiber diameter (D) is 3000 to 6000, which has been considered when the dispersibility in the medium is significantly reduced. In such a range, since the number of contact points between the fibers is increased and formation of a cross-linked structure is promoted, unique performance of the fiber dispersion liquid such as thixotropy can be exhibited, and an excellent reinforcing effect can be exhibited when the fiber dispersion liquid is applied as a sheet material or a filler.

From the viewpoint of the formation of the cross-linked structure, formation becomes easier as the fiber length becomes larger, that is, as the ratio becomes larger, and thus the reinforcing effect can be improved. However, when the ratio is excessively increased, partial agglomeration may occur, and the molding process may be complicated. Therefore, an upper limit of the ratio (L/D) is 6000, which is a range in which the ultrafine fibers are not entangled with each other while features provided by the fiber length can be sufficiently exhibited in addition to the specific surface area effect.

Although the assurance of the dispersibility becomes better as the ratio becomes smaller, which is advantageous from the viewpoint of uniform dispersion, the unique effect to be exhibited is reduced so that a lower limit value of the ratio (L/D) is 3000, which is also a range in which the fibers pass through the molding process without any problem such as fiber fall-off.

In view of application to a sheet material, the ultrafine fiber is more appropriately located in a space as the ratio (L/D) becomes smaller. That is, as the ratio (L/D) becomes smaller, the specific surface area effect of the ultrafine fiber can be thoroughly exhibited while ensuring air permeability. Therefore, to apply a sheet formed of the ultrafine fibers to an air filter, the ratio (L/D) can be in a preferable range of 3000 to 4500. In this example, the air filter can be an ideal filter medium which has high collection efficiency of dust or the like in spite of low pressure loss.

The ultrafine fiber is characterized by excellent dispersibility which is not achieved in any aqueous medium in related art, and it is necessary that a carboxyl terminal group amount of the ultrafine fiber is 40 eq/ton or more to achieve such uniform dispersibility, which is an important requirement.

The carboxyl terminal group amount herein is obtained as follows.

After washing the ultrafine fiber with pure water, 0.5 g of the ultrafine fiber is weighed and dissolved in an organic solvent such as ortho-cresol, and titrated with a potassium hydroxide ethanol solution or the like to calculate the carboxyl terminal group amount in units of eq/ton. The same operation is repeated five times, and a value obtained by rounding off a simple average value thereof to the nearest integer is referred to as the carboxyl terminal group amount.

A factor that inhibits the dispersibility of the ultrafine fibers in the aqueous medium is an attractive force generated between the ultrafine fibers due to the specific surface area, which can be said to be a morphological characteristic of the ultrafine fibers. To substantially prevent agglomeration (entanglement), a method of limiting forms of ultrafine fibers is adopted. However, such a method may not be a fundamental solution to prevent the agglomeration of the ultrafine fibers.

Therefore, we focused on the fact that a carboxyl group generates a negative charge in water and thus an electric repulsive force is applied as a method of maintaining excellent initial dispersibility without precipitation or the like even when a dispersion liquid is left to stand over time, and have studied details of a relationship between a carboxyl terminal group amount and dispersibility in an aqueous medium of ultrafine fibers formed of synthetic resin.

As a result, we found that, to uniformly disperse ultrafine fibers having fiber diameters of 100 to 5000 nm in the aqueous medium and maintain such a state for a long period of time without changing over time, the carboxyl terminal group amount of the ultrafine fibers needs to be 40 eq/ton or more.

That is, the initial dispersibility of the ultrafine fibers is ensured by controlling the forms of the ultrafine fibers or by using as a spacer of a surfactant or so on, but an carboxyl terminal group amount thereof is at most 20 to 30 eq/ton. Therefore, an electric repulsive force between the ultrafine fibers is lower than a cohesive force, and thus it is difficult to ensure the dispersibility.

The cohesive force can be reduced by setting a low aspect ratio for the ultrafine fibers, and thus the dispersibility can be ensured with the low electric repulsive force. However, the unique effect exerted by the ultrafine fibers is reduced, resulting in problems such as the fiber fall-off during the molding process so that development of applications of the fiber dispersion liquid is limited.

On the other hand, since the ultrafine fibers have a carboxyl terminal group amount of 40 eq/ton or more, the electric repulsive force derived from the carboxyl group acts between the innumerable ultrafine fibers, and thus the ultrafine fibers repel each other. Therefore, the ultrafine fibers continue to float in the aqueous medium without agglomeration. Such an effect also achieves uniform dispersibility without lowering the aspect ratio of the ultrafine fibers, which is restricted as the fibers become thinner in the related art.

Further, as the carboxyl terminal group amount increases, the applied repulsive force is also increased, and thus the dispersibility can be greatly improved. A fiber dispersion liquid using the ultrafine fibers, whose dispersibility is not impaired even after being left to stand for a long time, exhibits high dispersion stability. Such an ultrafine fiber dispersion liquid which has a high aspect ratio cannot be achieved by the related art, and thus possibility of development of applications of the ultrafine fiber dispersion liquid is increased. The dispersion liquid can be expected to be applied as, for example, a sheet material having complicated micropores or a high-performance filler.

Each ultrafine fiber preferably has a carboxyl terminal group amount of 40 eq/ton or more, and is preferably formed of a polymer having a large elastic modulus, that is, having excellent rigidity from the viewpoint of ensuring the dispersibility. The term "fiber having a large elastic modulus" as used herein refers to a fiber capable of reducing plastic deformation when deformation caused by an external force is applied. When the elastic modulus of the fiber is large, entanglement between the fibers can be prevented during a dispersion process of the ultrafine fiber or a high-order processing process of the fiber dispersion liquid, and thus the dispersibility of the fiber can be maintained.

When a sea-island fiber described later below is selected when manufacturing the ultrafine fiber, the sea-island fiber is preferably a thermoplastic polymer that can be melt-molded. By adjusting spinning conditions and the like, it is possible to improve an orientation of an island component and improve the elastic modulus.

Further, when materials such as a high-performance filter medium or a sound absorbing material is taken into consideration as a development of the fiber dispersion liquid containing the ultrafine fibers, performance such as heat resistance, weather resistance, or chemical resistance of the ultrafine fibers may be required.

Based on the fact described above, it is preferred that the ultrafine fibers are formed of polyester, and it is preferable that the ultrafine fibers are formed of polyester such as polyethylene terephthalate, polyethylene naphthalate, polybutylene terephthalate, and polytrimethylene terephthalate or a copolymer thereof, or a part of a surface layer of the ultrafine fiber is formed of such polyester. Such polyester is also preferable since a carboxyl terminal group amount thereof can be adjusted by, for example, changing a final polymerization temperature.

The ultrafine fiber may be formed of one kind of polyester, or may be formed of at least two different kinds of polyester. Although a part of the surface layer of the ultrafine fiber is preferably formed of the polyester, the ultrafine fiber may also contain a polymer other than polyester such as polypropylene, polyolefin, polycarbonate, polyacrylate, polyamide, polylactic acid, thermoplastic polyurethane, or polyphenylene sulfide.

If necessary, the ultrafine fiber may contain inorganic substances such as titanium oxide, silica, and barium oxide, colorants such as carbon black, dyes, and pigments, and various additives such as flame retardants, fluorescent brighteners, antioxidants, and ultraviolet absorbers in the polymer as long as the desired effect is not impaired.

A cross-sectional shape of the ultrafine fiber may be a round cross section or a modified cross section having a flat shape, a Y shape, a triangular shape, a polygonal shape or the like. In general, rigidity and glossiness are generated by forming a cross section of a fiber into a modified cross section. The ultrafine fiber is not an exception. When the cross section of the fiber is a modified cross section, dispersibility can be ensured by rigidity and functions such as unique adsorption characteristics and optical characteristics can be exhibited.

The ultrafine fiber is a composite fiber formed of at least two kinds of polymers, and preferably has a cross-sectional shape which has a sheath-core structure or a side-by-side structure. With such a cross-sectional shape, functions such as crimping characteristics, adsorption characteristics, optical characteristics, and water absorption characteristics can be uniquely imparted depending on a combination of the polymers.

As described above, when the cross section of the ultrafine fiber is a modified cross section, a modification degree thereof is preferably 1.1 to 5.0, and a modification degree variation is preferably 1.0% to 10.0% from the viewpoint of quality stability of characteristics. Within such a range, unique properties corresponding to the modification degree can be stably exhibited, and the existing ultrafine fibers have substantially the same cross-sectional shape.

Further, to more stably exhibit a more remarkable effect compared to a fiber having a round cross section, it is more preferable that the modification degree is 1.5 to 5.0 and the modification degree variation is 1.0% to 5.0%. An upper limit value of the modification degree is set to 5.0 in consideration of the handleability of the ultrafine fiber during processing when the present invention is implemented.

The modification degree herein is obtained as follows. That is, an image of a cross section (inside of an outer peripheral shape 1 shown in FIG. 1) of a fiber structure formed of ultrafine fibers is two-dimensionally captured by the same method as the fiber diameter. Based on the image, a diameter of a perfect circle (circumscribed circle 2 shown in FIG. 1) circumscribing the cross section of the fiber is referred to as a circumscribed circle diameter (fiber diameter of the ultrafine fiber), and a diameter of an inscribed perfect circle (inscribed circle 3 shown in FIG. 1) is referred to as an inscribed circle diameter. The modification degree is obtained from a formula that modification degree=circumscribed circle diameter/inscribed circle diameter, a value thereof is calculated up to a second decimal place and rounded off to the first decimal place.

The inscribed circle herein indicates a dashed-dotted line in FIG. 1 (inscribed circle 3 shown in FIG. 1). Such a modification degree is measured for 150 ultrafine fibers randomly extracted in the same image.

The modification degree variation refers to a value calculated from an average value and a standard deviation of the modification degree by a formula that the modification degree variation (modification degree CV %)=(standard deviation of modification degree/average value of modification degree)×100(%), and the value is rounded off to the first decimal place. Simple number average values of values measured for 10 images captured by the above operation are obtained as the modification degree and the modification degree variation, respectively.

The modification degree is less than 1.1 when a cut surface of the ultrafine fiber is a perfect circle or an ellipse similar to the perfect circle.

Next, a manufacturing method of polyethylene terephthalate (PET) will be described in detail as an example of a manufacturing method of the polyester suitable as the ultrafine fiber.

The ultrafine fiber is required to have a carboxyl terminal group amount of 40 eq/ton or more, and such a requirement can be controlled by polymerization conditions of PET.

PET can be obtained by a method in which a reaction product obtained by an esterification reaction of terephthalic acid and ethylene glycol is subjected to a polycondensation reaction, or a method in which a reaction product obtained by a transesterification reaction between a lower alkyl ester represented by dimethyl terephthalate and ethylene glycol is subjected to a polycondensation reaction.

For example, a reaction product obtained by a general transesterification reaction of dimethyl terephthalate and ethylene glycol at a temperature of 140 to 240° C. is subjected to a polycondensation reaction at 230 to 300° C. under reduced pressure such that a PET composition can be obtained.

A compound of lithium, manganese, calcium, magnesium, zinc or the like may be used as a catalyst to promote the transesterification reaction, and a phosphorus compound may be added after the transesterification reaction is substantially completed to deactivate the catalyst used in the reaction.

It is also preferable to add a compound such as an antimony-based compound, a titanium-based compound, or a germanium-based compound which serves as a polycondensation reaction catalyst to efficiently promote the reaction.

A carboxyl terminal group amount of PET can be adjusted to 40 eq/ton or more by adjusting an addition amount, an addition amount ratio, an addition order, an addition interval and the like of the metal compound and the phosphorus compound described above. Further, such adjustment can also be achieved by polymerization conditions, namely by lowering a degree of reduced pressure during polymerization, lengthening a polymerization time, and raising a polymerization temperature. For example, the addition amount of the phosphorus compound may be set to 1000 ppm or less with respect to PET, and the polymerization temperature may be set to 280 to 320° C. An oxazoline-based terminal blocking agent or the like may also be added.

By dispersing the ultrafine fibers described above in the aqueous medium, the obtained fiber dispersion liquid can satisfy the desired effect, the handleability during the molding process and the like.

The term "aqueous medium" refers to a medium whose substantial main component is formed of water, and may refer to any medium as long as an amount of water is 50% or more by weight with respect to a total weight of a liquid medium. Examples of such an aqueous medium include ion-exchanged water and distilled water, ion-exchanged water and distilled water in which a basic compound such as sodium hydroxide is dissolved, and an aqueous solution in which a salt is dissolved.

In the fiber dispersion liquid, it is necessary that ultrafine fibers having fiber diameters of 100 to 5000 nm are dispersed in the aqueous medium and the solid content concentration thereof is 0.01% to 10% by weight.

The solid content concentration herein is obtained as follows. That is, a fiber dispersion liquid is formed into a fiber structure formed of ultrafine fibers by a method such as filtration. The fiber structure is sufficiently dried, and then a weight thereof is measured to calculate the solid content concentration with respect to a total amount of the fiber dispersion liquid.

In the fiber dispersion liquid, it is preferable that the ultrafine fibers are uniformly dispersed without agglomeration. However, a factor that inhibits the dispersibility of the ultrafine fibers in the aqueous medium is the attractive force generated between the ultrafine fibers due to the specific surface area, which can be said to be the morphological characteristic of the ultrafine fibers, and thus there are instances where agglomeration (entanglement) of the fibers is likely to be formed depending on a state of existence of the fibers in the medium (distance between fibers).

That is, since density of the fibers in the medium increases as fiber concentration in the fiber dispersion liquid increases, which promotes the agglomeration of the fibers, an upper limit value of the solid content concentration is set to 10% by weight, and thus the agglomeration of the fibers can be prevented.

A lower limit value of the solid content concentration is 0.01% by weight, which is preferable since the fiber dispersion liquid exhibits characteristics derived from the specific surface area of the ultrafine fibers within this range.

The solid content concentration is preferably 0.05% to 5% by weight in consideration of efficient exhibition of the characteristics of the fiber dispersion liquid. Moreover, the dispersibility of the fibers present in the fiber dispersion liquid is extremely high, and thus the solid content concentration is more preferably 0.1% to 3% by weight from the viewpoint of making the effect more remarkable. In such a range, since the fiber dispersion liquid contains the fibers at higher concentration, efficiency can be improved when the fiber dispersion liquid is processed into a sheet or the like. Further, such a fact means that a ratio of the ultrafine fibers contained in the sheet can be appropriately adjusted, which is preferable in consideration of high-order processing.

Further, to achieve the desired effect, it is necessary that a dispersion state of the fibers in the medium is uniform, and thus it is extremely important that a dispersion index of the fiber dispersion liquid defined as follows is 20 or less.

The dispersion index is obtained as follows. An image of a fiber dispersion liquid prepared such that solid content concentration is 0.01% by weight with respect to a total amount of the fiber dispersion liquid is captured by a microscope at a magnification of 50 times under transmission illumination, the image is converted into a monochrome image by using image processing software, then a luminance histogram is formed with 256 grades, and a standard deviation obtained therefrom is evaluated as the dispersion index. Hereinafter, measurement of the dispersion index will be described in detail with reference to FIGS. 2A and 2B.

Figure 2A:
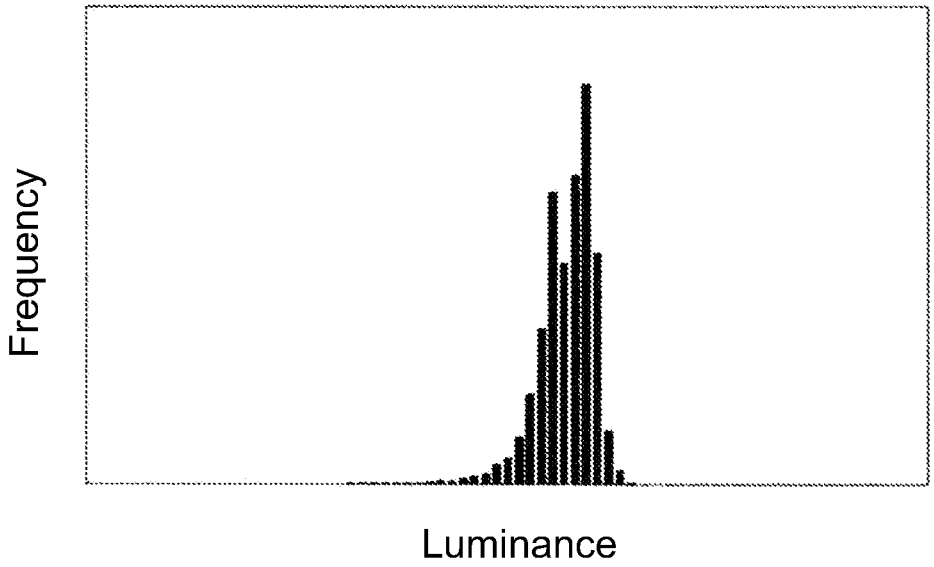
Figure 2B:
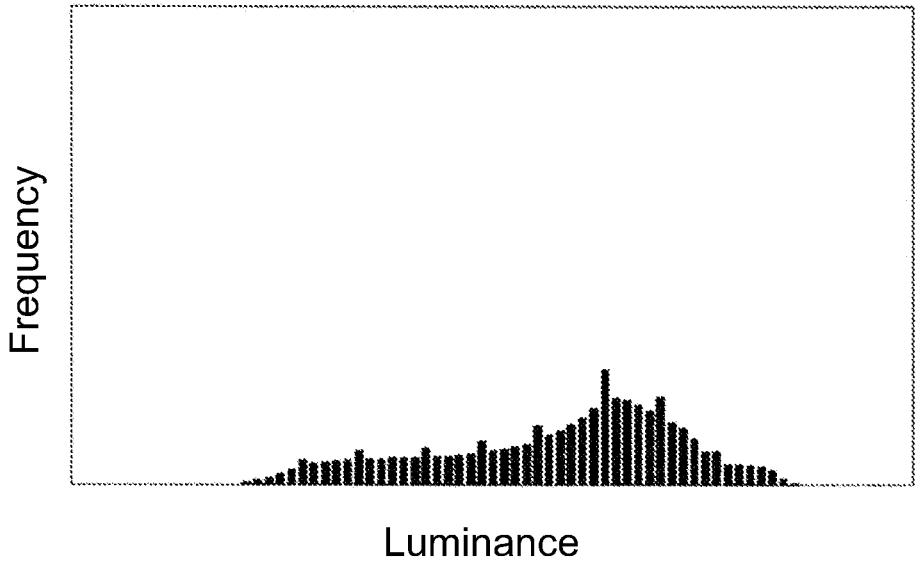

FIG. 2A shows an example of the luminance histogram (vertical axis: frequency (number of pixels), horizontal axis: luminance) of a fiber dispersion liquid having good dispersibility, while FIG. 2B shows an example of the luminance histogram when the dispersibility is poor and a fiber agglomerate is formed.

The luminance histogram herein is used to evaluate the dispersibility by the following method. That is, the image of the fiber dispersion liquid obtained by dispersing in the aqueous medium such that the solid content concentration is 0.01% by weight with respect to the total amount of the fiber dispersion liquid is captured with the microscope at the magnification of 50 times under the transmission illumination. The image is converted into the monochrome image by using an image processing software, the luminance histogram is formed with 256 grades, and the dispersibility is evaluated based on a peak width of the obtained luminance histogram.

That is, if the dispersion of the fibers is uniform, there is no large light-dark difference in the image, and thus the peak width is narrow and the standard deviation is small (FIG. 2A). On the other hand, if the dispersion of the fibers is not uniform, light and dark are locally separated, and thus the standard deviation increases as the peak width becomes wider (FIG. 2B). Therefore, the dispersibility can be evaluated by using the standard deviation as the dispersion index.

When the dispersion index herein is 20 or less, it can be evaluated that the fibers are uniformly dispersed. The fibers have unique performance which cannot be achieved by the related art, and is also excellent in handleability during the molding process.

From the viewpoint of ideal uniform dispersion, a lower limit value of the dispersion index is 1.0 since the uniform dispersion is achieved better as the value of the dispersion index decreases. Within this range, even when the fiber dispersion liquid is formed into a fiber structure by a wet-laid forming method or the like, the fiber structure have fine micropores provided by uniform arrangement of the ultrafine fibers, and adsorption performance or the like derived from the specific surface area of the ultrafine fibers can be thoroughly exhibited. Therefore, it is preferable that the dispersion index of the fiber dispersion liquid is within the above range.

Further, the dispersion index is more preferably 15 or less from the viewpoint of the application to the sheet material since the ultrafine fibers are more uniformly present in a space as the value of the dispersion index becomes smaller, and thus unique performance such as adsorption performance derived from the ultrafine fibers can be stably exhibited without unevenness over the entire sheet. From such a viewpoint, it is preferable that the dispersion index is smaller, and a more preferable range is that the dispersion index is 10 or less.

Further, the fiber dispersion liquid preferably has a dispersion stability index defined by the following formula of 0.70 or more.

$$\text{Dispersion stability index}=H_0/H$$

In the formula, $H_0$ is a height of the fiber dispersion liquid in a container after standing for 10 minutes, and $H_1$ is a dispersion height of the fiber dispersion liquid in the container after standing for 7 days.

The dispersion stability index is obtained as follows. That is, 45 g of the fiber dispersion liquid prepared such that the solid content concentration is 0.5% by weight with respect to the total amount of the fiber dispersion liquid is put into a 50 mL screw tube bottle (for example, manufactured by AS ONE Corporation), and an image of the screw tube bottle after standing for 10 minutes and an image after standing for 7 days are captured from the same angle. After using an image processing software to convert the image into a monochrome image, the fiber dispersion liquid in the screw tube bottle is automatically binarized. Then, for example, a fiber dispersion portion is binarized into green while an aqueous medium portion is binarized into black, and a height of the fiber dispersion (green) is measured to calculate and evaluate the dispersion stability index by the above formula.

If the dispersion stability index herein is 0.70 or more, the fiber dispersion liquid can be evaluated as exhibiting high dispersion stability without impairing dispersibility even after standing for a long time, and thus the fiber dispersion liquid is excellent in handleability and quality stability.

In particular, from the viewpoint of maintaining quality of the fiber dispersion liquid, it is preferable that the dispersion stability index is larger, and it is more preferable that the dispersion stability index is 0.90 or more. Since the total amount of the fiber dispersion liquid does not change during the standing, an upper limit value of the dispersion stability index is 1.00.

Considering the handleability during the molding process of the fiber dispersion liquid which is excellent in dispersibility and dispersion stability as described above, it is preferable that the fiber dispersion liquid has so-called thixotropy, which is a characteristic that low viscosity is exhibited under a high shearing force such as spraying or applying of the fiber dispersion liquid while high viscosity is exhibited under a low shearing force (during standing) to prevent liquid dripping or the like.

That is, the fiber dispersion liquid preferably has a thixotropy index (TI) defined by the following formula in the fiber dispersion liquid prepared such that the solid content concentration is 0.5% by weight with respect to the total amount of the fiber dispersion liquid of 7.0 or more.

$$\text{Thixotropy index } (TI)=\eta_6/\eta_{60}$$

In the formula, $\eta_6$ is viscosity (at 25° C.) of the fiber dispersion liquid prepared such that the solid content concentration is 0.5% by weight with respect to the total amount of the fiber dispersion liquid measured at a rotation speed of 6 rpm, and $\eta_{60}$ is viscosity (at 25° C.) of the fiber dispersion liquid measured at a rotation speed of 60 rpm.

Specifically, 250 g of the fiber dispersion liquid prepared such that the solid content concentration is 0.5% by weight with respect to the total amount of the fiber dispersion liquid is put into a 250 mL polypropylene container, left to stand at 25° C. for 30 minutes. Then rotor stirring is performed at predetermined rotation speeds (6 rpm and 60 rpm) for 1 minute through using a B-type viscometer, viscosity at that time is measured to calculate the thixotropy index (TI), and the value is rounded off to the first decimal place.

In general, the thixotropy index (TI) is used as one of parameters for evaluating thixotropy. A larger value of the thixotropy index (TI) indicates better thixotropy. The thixotropy of the fiber dispersion liquid greatly depends on an aspect ratio of the ultrafine fibers dispersed in the medium.

That is, a fiber dispersion liquid in which ultrafine fibers having a large aspect ratio are uniformly dispersed exhibits high viscosity under a low shearing force (in a stationary state) since a so-called cross-linked structure is formed due to the fact that there are a large number of contact points between the fibers in the medium. On the other hand, under a high shearing force, the cross-linked structure is broken and thus low viscosity is exhibited.

When the thixotropy index (TI) is 7.0 or more, which is a range that cannot be achieved by fiber dispersion liquid obtained in the related art, the fiber dispersion liquid has excellent thixotropy and has good handleability during the molding process. In consideration of the fact that the handleability is deteriorated when the viscosity under the low shearing force is excessively large, an upper limit value of the thixotropy index (TI) is preferably 20.0. From the above viewpoint, in consideration of exhibition of the thixotropy and molding processability, the thixotropy index (TI) of the fiber dispersion liquid is more preferably 7.0 to 15.0.

The fiber dispersion liquid satisfying the above requirements has sufficiently high fiber dispersibility and dispersion stability in the medium while exhibiting excellent thixotropy, and thus can be expected as a high-performance material.

If necessary, a dispersant may be contained in the fiber dispersion liquid to prevent agglomeration of the ultrafine fibers over time and to increase viscosity of the medium in the fiber dispersion liquid.

Examples of kinds of the dispersant include natural polymers, synthetic polymers, organic compounds, and inorganic compounds. Examples of the dispersant for preventing the agglomeration of the fibers include cationic compounds, nonionic compounds, and anionic compounds. In particular, for the purpose of improving dispersibility, it is preferable to use the anionic compound from the viewpoint of the electric repulsive force in the aqueous medium.

An addition amount of such dispersants is preferably 0.001 to 10 equivalents with respect to the ultrafine fibers. When the addition amount is in such a range, a function thereof can be sufficiently imparted without impairing the characteristics of the fiber dispersion liquid.

As described above, we achieve excellent dispersibility and dispersion stability of ultrafine fibers, which have not previously been achieved, and an example of a manufacturing method thereof will be described in detail below.

The ultrafine fiber can be manufactured, for example, by using a sea-island fiber formed of two or more kinds of polymers (for example, polymer A and polymer B) having different dissolution rates in a solvent. The term "sea-island fiber" to a fiber having a structure in which island components formed of a hardly soluble polymer are scattered in a sea component formed of an easily soluble polymer.

As a method of producing such a sea-island fiber, a method using sea-island composite spinning by melt spinning is preferable from the viewpoint of improving productivity, and a method using a sea-island composite spinneret is preferable from the viewpoint of excellent control of a fiber diameter and a cross-sectional shape.

A reason for using the melt spinning method is that the productivity is high and continuous production is possible, and it is also preferable to use such a method since a so-called sea-island composite cross section can be stably formed during the continuous production. From the viewpoint of stability of the cross section over time, it is important to consider a combination of polymers that form the sea-island fiber. The polymers are preferably selected to form a combination in which a melt viscosity ratio ($\eta B/\eta A$) of melt density $\eta A$ of the polymer A to melt viscosity $\eta B$ of the polymer B is within a range of 0.1 to 5.0.

The term "melt viscosity" refers to melt viscosity that can be measured by a capillary rheometer after a moisture content of a chip-shaped polymer is set to 200 ppm or less by a vacuum dryer, and refers to melt viscosity at the same shear rate at a spinning temperature.

When melt spinning is selected, examples of the polymer components include melt-moldable polymers such as polyethylene terephthalate, polyethylene naphthalate, polybutylene terephthalate, polytrimetylene terephthalate, polypropylene, polyolefin, polycarbonate, polyacrylate, polyamide, polylactic acid, thermoplastic polyurethane, and polyphenylene sulfide, and copolymers thereof. In particular, it is preferable that the polymer has a melting point of 165° C. or higher since the heat resistance is excellent.

Inorganic substances such as titanium oxide, silica, and barium oxide, colorants such as carbon black, dyes, and pigments, and various additives such as flame retardants, fluorescent brighteners, antioxidants, and ultraviolet absorbers may also be contained in the polymer.

In a preferable combination of the sea component and the island component for spinning the sea-island fiber suitable for manufacturing our ultrafine fiber, the island component is selected depending on intended use, and the sea component is selected to be capable of being spun at the same spinning temperature based on a melting point of the island component. It is preferable that a molecular weight and the like of each component are adjusted in consideration of the melt viscosity ratio described above from the viewpoint of improving homogeneity such as the cross-sectional shape and the fiber diameter of the island component.

For example, it is preferable to use polyethylene terephthalate, polyethylene naphthalate, polybutylene terephthalate, polytrimethylene terephthalate, polyamide, polylactic acid, thermoplastic polyurethane, or polyphenylene sulfide with varied molecular weights as the polymer A and the polymer B, or to use one as a homopolymer and the other as a copolymer.

Further, it is preferable to select the sea component from polymers that exhibit easier solubility than other components (easily soluble polymers), and it is preferable to select the combination from the polymers such that a dissolution rate ratio (dissolution rate of easily soluble polymer/dissolution rate of hardly soluble polymer) is 100 or more based on the hardly soluble polymer with respect to a solvent used for dissolving and removing the sea component.

The term "easily soluble polymer" means that the dissolution rate ratio is 100 or more based on the hardly soluble polymer with respect to the solvent used for dissolving and removing the sea component.

In consideration of simplification of a dissolution process and reduction in time during high-order processing, the dissolution rate ratio is preferably larger. During manufacturing of the ultrafine fiber, the dissolution rate ratio is preferably 1000 or more, and more preferably 10000 or more. In this range, since the dissolution process can be completed in a short time, the ultrafine fiber can be obtained without unnecessarily deteriorating the hardly soluble component.

The easily soluble polymer suitable for manufacturing the ultrafine fiber is, for example, selected from melt-moldable polymers such as polyethylene terephthalate, polyethylene naphthalate, polybutylene terephthalate, polytrimetylene terephthalate, polypropylene, polyolefin, polycarbonate, polyacrylate, polyamide, polylactic acid, thermoplastic polyurethane, and polyphenylene sulfide, and copolymers thereof.

In particular, from the viewpoint of simplifying an elution process of the sea component, the sea component is preferably a copolyester, polylactic acid, polyvinyl alcohol or the like which easily elutes in an aqueous solvent, hot water or the like. In particular, from the viewpoint of handleability and easy dissolution in an aqueous solvent having low concentration, it is preferable to use a copolyester obtained by copolymerization of polyethylene glycol or sodium sulfoisophthalic acid alone or in combination or polylactic acid.

From the viewpoint of solubility in an aqueous solvent and simplification of treatment of waste liquid generated in dissolution, polylactic acid, polyester in which 5-sodium sulfoisophthalic acid is copolymerized in a range of 3 mol % to 20 mol %, and polyester in which polyethylene glycol having a weight average molecular weight of 500 to 3000 is copolymerized in a range of 5 wt % to 15 wt % in addition to 5-sodium sulfoisophthalic acid described above are particularly preferable.

From the above viewpoint, as the combination of the preferred polymers adopted to obtain the sea-island fiber suitable for manufacturing the ultrafine fiber, for example, it is preferable to select the sea component from polyester in which 5-sodium sulfoisophthalic acid is copolymerized in a range of 3 mol % to 20 mol % while polyethylene glycol having a weight average molecular weight of 500 to 3000 is copolymerized in a range of 5 wt % to 15 wt % and polylactic acid, and select the island component from polyethylene terephthalate, polytrimethylene terephthalate, polybutylene terephthalate, polyethylene naphthalate, and copolymers thereof.

A ratio (weight ratio) of the sea component to the island component used for spinning the sea-island fiber suitable to manufacture the ultrafine fiber can be selected such that the sea component/island component ratio is in a range of 5/95 to 95/5 based on a discharge amount. The ratio of the island component among the sea component/island component ratio is preferably increased from the viewpoint of productivity of the ultrafine fiber. However, from the viewpoint of long-term stability of the sea-island composite cross section, the sea component/island component ratio is preferably 10/90 to 50/50, which is a range in which the ultrafine fiber is efficiently manufactured while maintaining stability.

The number of islands in the sea-island fiber suitable for manufacturing the ultrafine fiber is preferably 2 to 10000, which is a practically feasible range. A range in which the sea-island fiber is reasonably satisfied is 100 to 10000 islands, and filling density of the islands may be 0.1 to 20 islands/$mm^2$. From the viewpoint of the filling density of the islands, 1 to 20 islands/$mm^2$ is a preferable range.

The term "filling density of islands" refers to the number of islands per unit area. The sea-island fiber can be manufactured with more islands as the value of the filling density of islands increases. The filling density of islands herein is a value obtained by dividing the number of islands discharged from a discharge hole by an area of a discharge introduction hole.

The spinning temperature of the sea-island fiber suitable for manufacturing the ultrafine fiber is preferably a temperature at which a polymer having a high melting point or high viscosity among the polymers to be used and determined from the viewpoints described above exhibits flowability. The temperature at which the flowability is exhibited varies depending on characteristics of the polymer and a molecular weight thereof, and may be set to be equal to or lower than the melting point +60° C., using the melting point of the polymer as a reference. At this temperature, a decrease in the molecular weight is prevented without thermal decomposition of the polymer in a spinning head or a spinning pack, and thus the sea-island fiber can be favorably manufactured.

A discharge amount of a sea-island composite polymer in spinning the sea-island fiber suitable for manufacturing the ultrafine fiber is, for example, 0.1 g/min/hole to 20.0 g/min/hole per discharge hole, in which melting and discharging can be performed while maintaining stability. At this time, it is preferable to consider pressure loss in the discharge hole that can ensure discharge stability. The discharge amount is preferably determined to set the pressure loss herein to be 0.1 MPa to 40 MPa as a reference from the range considering a relationship with the melt viscosity of the polymer, a discharge hole diameter, and a discharge hole length.

A filament melted and discharged from the discharge hole is cooled and solidified, converged by applying an oil agent or the like, and taken up by a roller which has a specified peripheral speed. A speed of the take-up is determined based on the discharge amount and a target fiber diameter, and is preferably 100 m/min to 7000 m/min from the viewpoint of stably manufacturing the sea-island fiber.

The spun sea-island fiber is preferably drawn from the viewpoint of improving thermal stability and mechanical properties, and a spun multifilament may be wound once and then drawn, or drawing may be performed after spinning without winding.

For example, in a drawing machine including one or more pairs of rollers when the fiber is formed of a polymer exhibiting a thermoplastic property that can be spun by general melt spinning, drawing conditions are set such that the fibers are reasonably drawn in a fiber axis direction, and are heat-set and wound based on a peripheral speed ratio of a first roller, which is set to a temperature equal to or higher than the glass transition temperature and equal to or lower than the melting point, to a second roller set to be equivalent to a crystallization temperature. From the viewpoint of increasing a draw ratio and improving the mechanical properties, it is also preferable to perform the drawing process in multiple stages.

It is preferable that the sea-island fibers obtained as described above are bundled into a tow in units of several tens to several millions, and cut into a desired fiber length by using a cutting machine such as a guillotine cutter, a slicing machine, or a cryostat. The fiber length (L) at this time is cut such that the ratio (L/D) to an island component diameter (corresponding to the fiber diameter (D)) is 3000 to 6000. The island component diameter herein is substantially equal to the fiber diameter of the ultrafine fiber, and is obtained as follows.

The sea-island fiber is embedded in an embedding agent such as an epoxy resin, and an image of a cross section thereof is captured by a transmission electron microscope (TEM) at a magnification at which 150 or more island components can be observed. When 150 or more island components are not arranged in one filament, images of fiber cross sections of several filaments may be captured to observe 150 or more island components in total. At this time, a contrast of the island components can be made clearer by metal dyeing. Island component diameters of 150 island components randomly extracted from each captured image of the fiber cross section are measured. The term "island component diameter" refers to a diameter of a perfect circle circumscribing a cut surface which is a cross section taken in a direction perpendicular to a fiber axis based on a two-dimensionally captured image.

By dissolving and removing the sea component from the sea-island fiber obtained as described above, the ultrafine fiber and the fiber dispersion liquid can be manufactured. That is, the easily soluble component (sea component) may be removed by immersing the sea-island fiber after the cutting process in a solvent or the like capable of dissolving the easily soluble component. When the easily soluble component is copolymerized polyethylene terephthalate obtained by copolymerizing 5-sodium sulfoisophthalic acid, polyethylene glycol or the like and polylactic acid, an alkaline aqueous solution such as a sodium hydroxide aqueous solution can be used.

In this example, a bath ratio of the sea-island fiber to the alkaline aqueous solution (sea-island fiber weight (g)/alkaline aqueous solution weight (g) is preferably 1/10000 to 1/5, and more preferably 1/5000 to 1/10. Within this range, it is possible to prevent agglomeration caused by entanglement of the ultrafine fibers during dissolution of the sea component.

At this time, alkali concentration of the alkaline aqueous solution is preferably 0.1% to 5% by weight, and more preferably 0.5% to 3% by weight. Within this range, the dissolution of the sea component can be completed in a short time, and a fiber dispersion liquid in which the ultrafine fibers are homogeneously dispersed can be obtained without unnecessarily deteriorating the island component. Although a temperature of the alkaline aqueous solution is not particularly limited, progress of the dissolution of the sea component can be accelerated by setting the temperature to 50° C. or higher.

It is possible to directly use a material in which the easily soluble component (sea component) is dissolved from sea-island fibers so that the ultrafine fibers are dispersed, or it is also possible to separate the ultrafine fibers once by filtration or the like, wash the ultrafine fibers with water, freeze drying the ultrafine fibers and then dispersing the ultrafine fibers again in an aqueous medium. In consideration of high-order processing to be used and handleability therein, the fiber dispersion liquid can be used after being added with acid or alkali to adjust pH of the medium or diluted with water.

As described above, the fiber dispersion liquid in which the ultrafine fibers are uniformly dispersed in the medium is prepared. Such a fiber dispersion liquid can be made into a sheet material by wet-laid forming or the like and then developed into a high-performance filter medium, a next-generation sound-absorbing material, a battery separator and the like. The fiber dispersion liquid can also be expected as a material that can be applied to applications that cannot be achieved with functional particle dispersion liquid in the related art such as fillers for resin, paint and cosmetics, thickeners, and optical materials.

By using our ultrafine fiber, various fiber products can be manufactured by using known methods via intermediates such as a fiber take-up package, a tow, cut fibers, cotton, a fiber ball, a cord, a pile, a woven fabric, a non-woven fabric, paper, and a liquid dispersion.

Examples of such fiber products include general clothing products (such as jackets, skirts, pants, and underwear), sports clothing, clothing materials, interior products (such as carpets, sofas, and curtains), vehicle interior products (such as car seats), daily products (such as cosmetics, cosmetic masks, wiping cloth, and health products), industrial materials (such as polishing cloth, filters, hazardous substance removal products, and battery separators), and medical products (such as suture threads, scaffolds, artificial blood vessels, and blood filters).

EXAMPLES

Our ultrafine fiber and fiber dispersion liquid will be described in detail below with reference to examples. The following evaluations are performed for the examples and comparative examples.

A. Melt Viscosity of Polymer

A chip-shaped polymer is dried by a vacuum dryer to have a moisture content of 200 ppm or less, and melt viscosity thereof is measured at a strain rate of 1216 $s^{-1}$ by Capilograph 1B manufactured by Toyo Seiki Seisaku-sho. A measurement temperature in each of the examples and the comparative examples is set to be equal to the spinning temperature, and it takes 5 minutes from a time when a sample is put into a heating furnace in a nitrogen atmosphere to a time when a measurement of melt viscosity is started.

B. Fiber Diameter

An image of a fiber structure formed of ultrafine fibers is captured by a scanning electron microscope (SEM) manufactured by HITACHI at a magnification at which 150 to 3000 single fibers can be observed. From the captured image, 150 fibers are randomly extracted, image processing software (WINROOF) is used to measure fiber diameters, and an average value thereof is calculated. Such an operation is performed on each photograph at 10 places to perform the measurement. An average value of obtained results is calculated in units of nm, and the value is rounded off to the nearest integer as the fiber diameter.

C. Fiber Length

A fiber dispersion liquid is prepared by dispersing ultrafine fibers in an aqueous medium such that solid content concentration is 0.01% by weight with respect to a total amount of the fiber dispersion liquid. The fiber dispersion liquid is dropped on a glass substrate, and an image thereof is captured at a magnification at which 10 to 100 ultrafine fibers, whose total length can be measured by VHX-2000 microscope, which is a microscope manufactured by Keyence Corporation, can be observed. From the image, 10 ultrafine fibers randomly selected are extracted, and image processing software (WINROOF) is used to measure the fiber length (L). The measurement is performed in units of mm up to a second decimal place, the same operation is performed on 10 images, and a value obtained by rounding off a simple number average value thereof to the first decimal place is defined as the fiber length.

D. Carboxyl Terminal Group Amount (eq/ton)

A fiber structure formed of ultrafine fibers is washed with pure water, 0.5 g of the fiber structure is precisely weighed, 40 mL of ortho-cresol is added and the fiber structure is dissolved at 90° C., and titrated using a 0.04N potassium hydroxide ethanol solution to perform calculation in units of eq/ton. The same operation is repeated five times, and a value obtained by rounding off a simple average value thereof to the nearest integer is defined as the carboxyl terminal group amount.

E. Modification Degree and Modification Degree Variation (CV %)

An image of a cross section of a fiber structure formed of ultrafine fibers is captured by the same method as the fiber diameter. A diameter of a perfect circle (circumscribed circle 2 shown in FIG. 1) circumscribing a cut surface of each cross section is defined as a circumscribed circle diameter, and a diameter of an inscribed perfect circle (inscribed circle 3 shown in FIG. 1) is defined as an inscribed circle diameter. Based on a formula that modification degree=circumscribed circle diameter/inscribed circle diameter, a modification degree is calculated to be a value rounded off to the first decimal place.

Such an operation is performed on 10 cross sections, and an average value and a standard deviation thereof are used to calculate a modification degree variation (CV %) based on the following formula.

Modification degree variation (CV %)=(standard deviation of modification degree/average value of modification degree)×100(%)

The measurement is performed at 10 places for each photograph, an average value of the 10 places is rounded off to the first decimal place, and the obtained value is defined as the modification degree variation.

F. Dispersion Index

An image of a fiber dispersion liquid prepared such that solid content concentration thereof is 0.01% by weight with respect to a total amount of the fiber dispersion liquid is captured with a microscope VHX-2000 manufactured by Keyence Corporation at a magnification of 50 times under transmission illumination. The image is converted into a monochrome image by using image processing software (WINROOF), a luminance histogram is obtained with 256 grades (vertical axis: frequency (number of pixels), horizontal axis: luminance), and a standard deviation is obtained therefrom. The same operation is performed on 10 images, a simple number average value thereof is rounded off to the first decimal place and the obtained value is defined as a dispersion index.

G. Dispersion Stability Index

A fiber dispersion liquid in an amount of 45 g prepared such that solid content concentration thereof is 0.5% by weight with respect to a total amount of the fiber dispersion liquid is put into a 50 mL screw tube bottle (manufactured by AS ONE Corporation), and an image of the screw tube bottle after standing for 7 days is captured from the same angle. After using image processing software to convert the image into a monochrome image, the fiber dispersion liquid in the screw tube bottle is automatically binarized. Then, for example, a fiber dispersion portion is binarized into green while an aqueous medium portion is binarized into black, and a height of the fiber dispersion (green) is measured to calculate a dispersion stability index by the above formula, in which the value is rounded off to the second decimal place.

Dispersion stability index=$H_0/H_1$ $H_0$ is a height of the fiber dispersion liquid in a container after standing for 10 minutes, and $H_1$ is a dispersion height of the fiber dispersion liquid in the container after standing for 7 days.

H. Thixotropy Index (TI)

A fiber dispersion liquid in an amount of 250 g prepared such that solid content concentration thereof is 0.5% by weight with respect to a total amount of the fiber dispersion liquid is put into a 250 mL polypropylene container, left to stand at 25° C. for 30 minutes. Then rotor stirring is performed at predetermined rotation speeds (6 rpm and 60 rpm) for 1 minute through using a B-type viscometer manufactured by TOKYO KEIKI INC., viscosity at that time is measured to calculate a thixotropy index by the following formula, where the value is rounded off to the first decimal place.

Thixotropy index ($TI$)=$\eta_6/\eta_{60}$

In the formula, $\eta_6$ is viscosity (at 25° C.) measured at a rotation speed of 6 rpm, and $\eta_{60}$ is viscosity (at 25° C.) measured at a rotation speed of 60 rpm.

Example 1

Polyethylene terephthalate (PET 1, melt viscosity: 160 Pa·s) is used as an island component while polyethylene terephthalate (copolymerized PET, melt viscosity: 121 Pa·s) obtained by copolymerizing 8.0 mol % of 5-sodium sulfoisophthalic acid and 10 wt % of polyethylene glycol having a weight average molecular weight of 1,000 is used as a sea component (melt viscosity ratio: 1.3, dissolution rate ratio: 30000 or more). A sea-island composite spinneret (number of islands: 2000) having round island component shapes is used to melt and discharge a filament with a sea component/island component composite ratio (weight ratio) of 50/50, and then the filament is cooled and solidified. Thereafter, an oil agent is applied thereto, and an undrawn yarn is obtained by winding at a spinning speed of 1000 m/min (total discharge amount: 12 g/min). Further, the undrawn yarn is drawn at a draw ratio of 3.4 times between a roller heated to 85° C. and a roller heated to 130° C. (drawing speed: 800 m/min) to obtain a sea-island fiber.

The sea-island fiber has a strength of 2.4 cN/dtex and an elongation rate of 36%, which are mechanical properties sufficient for cutting, and cutting is performed such that the fiber length is 0.6 mm.

When 99% or more of the sea component is dissolved and removed from the sea-island fiber in a 1 wt % sodium hydroxide aqueous solution (bath ratio: 1/100) heated to 90° C., an ultrafine fiber having a fiber diameter of 200 nm, L/D of 3000, and a carboxyl terminal group amount of 52 eq/ton is obtained. Moreover, the ultrafine fiber has a round cross-sectional shape, a modification degree of 1.0, a modification degree variation of 4.9%, and is thus excellent in homogeneity.

Next, an image of a fiber dispersion liquid prepared such that solid content concentration thereof is 0.01% by weight with respect to a total amount of the fiber dispersion liquid is captured with a microscope, and the image is analyzed to obtain a luminance histogram. At this time, if fiber dispersion is uniform, there is no large light-dark difference, and thus a standard deviation thereof is small. On the other hand, if the fiber dispersion is not uniform, light and dark are locally separated, and thus the standard deviation is large. When the dispersibility of the fiber dispersion liquid of Example 1 is evaluated, no agglomeration caused by entanglement of the ultrafine fibers is observed, and the dispersion index is 10.1, which indicates excellent dispersibility.

Dispersion heights before and after standing for 7 days of the fiber dispersion liquid that has the solid content concentration of 0.5% by weight with respect to the total amount of the fiber dispersion liquid are compared. In the fiber dispersion liquid of Example 1, no ultrafine fiber precipitation is observed even after standing for 7 days, and the dispersion stability index is 1.00, which indicates excellent dispersion stability.

Further, viscosity of the fiber dispersion liquid which has the solid content concentration of 0.5% by weight with respect to the total amount of the fiber dispersion liquid is measured respectively at a rotation speed of 6 rpm and a rotation speed of 60 rpm to evaluate thixotropy. The viscosity of the fiber dispersion liquid of Example 1 significantly decreases under a high shearing force (60 rpm), and has a thixotropy index (TI) of 8.5, which indicates favorable thixotropy.

As described above, the fiber dispersion liquid of Example 1 has uniform dispersion of the ultrafine fibers and high dispersion stability, and exhibits excellent thixotropy. A result thereof is shown in Table 1.

Examples 2 and 3

All processes are performed in the same manner as in Example 1 except that the total discharge amount is 24 g/min and cutting is performed such that the fiber length (L) is 1.2 mm (Example 2) and 1.8 mm (Example 3), respectively.

In each of Examples 2 and 3, the fiber diameter (D) of the ultrafine fiber is 300 nm, and the carboxyl terminal group amount is 52 eq/ton. An aspect ratio of a fiber dispersion liquid containing such ultrafine fibers is higher compared to that of Example 1, and thus fiber agglomeration is easily formed. However, the dispersion index is 20 or less, which indicates excellent dispersibility, and the dispersion stability index is 1.00, which indicates excellent dispersion stability.

Since thixotropy depends on the aspect ratio, the obtained thixotropy index (TI) exhibits a larger value as compared with that of Example 1. A result thereof is shown in Table 1.

Comparative Example 1

All processes are performed in the same manner as in Example 1 except that cutting is performed such that the fiber length is 5.0 mm.

Ultrafine fibers obtained in Comparative Example 1 locally cause agglomeration in the medium due to fiber entanglement since the fiber length (L) is excessively large compared to the fiber diameter (D) (L/D=10000), and the dispersion index is 35.2 that indicates significantly low dispersibility. Therefore, the dispersion stability index and the thixotropy index (TI) are also significantly low. A result thereof is shown in Table 1.

Example 4

All processes are performed in the same manner as in Example 1 except that polyethylene terephthalate (PET 2, melt viscosity: 140 Pa·s) different from that of Example 1 is used as the island component.

Ultrafine fibers obtained in Example 4 have a carboxyl terminal group amount of 40 eq/ton, which is lower compared to that of Example 1. However, since an electric repulsive force derived from carboxyl groups is sufficiently applied, the dispersion index is 12.0 and the dispersion stability index is 0.72, which indicate favorable dispersibility and dispersion stability. A result thereof is shown in Table 1.

Comparative Example 2

All processes are performed in the same manner as in Example 1 except that polyethylene terephthalate (PET 3, melt viscosity: 120 Pa·s) different from those of Examples 1 and 4 is used as the island component.

Ultrafine fibers obtained in Comparative Example 2 have a carboxyl terminal group amount of 28 eq/ton. Since the electric repulsive force derived from the carboxyl groups is not sufficient compared to Examples 1 and 4, agglomeration caused by fiber entanglement is partially observed, and the dispersion index and dispersion stability index are inferior to those of Example 1. Moreover, since the dispersibility is insufficient, the thixotropy index (TI) is also inferior. A result thereof is shown in Table 1.

Example 5

All processes are performed in the same manner as in Example 1 except that a sea-island composite spinneret whose number of islands is 1000 is used, the total discharge amount is 42 g/min, cutting is performed such that the fiber length (L) is 1.8 mm, then an anionic dispersant manufactured by DKS Co. Ltd. (Shallot AN-103P: molecular weight 10000) is added in an amount of 1.0 equivalent to ultrafine fibers to make the solid content concentration 1.0% by weight.

The ultrafine fibers obtained in Example 5 have a fiber diameter of 600 nm, L/D of 3000, and a carboxyl terminal group amount of 52 eq/ton. A result thereof is shown in Table 2.

Example 6

All processes are performed in the same manner as in Example 5 except that a sea-island composite spinneret whose number of islands is 500 is used, the total discharge amount is 42 g/min and cutting is performed such that the fiber length (L) is 2.7 mm.

The ultrafine fibers obtained in Example 6 have a fiber diameter of 900 nm, L/D of 3000, and a carboxyl terminal group amount of 52 eq/ton. A result thereof is shown in Table 2.

Example 7

All processes are performed in the same manner as in Example 5 except that a sea-island composite spinneret whose number of islands is 1000 is used, the total discharge amount is 64 g/min, the sea component/island component composite ratio is 20/80 and cutting is performed such that the fiber length is 3.0 mm.

Ultrafine fibers obtained in Example 7 have a fiber diameter of 1000 nm, L/D of 3000, and a carboxyl terminal group amount of 52 eq/ton. A result thereof is shown in Table 2.

Example 8

All processes are performed in the same manner as in Example 5 except that a sea-island composite spinneret whose number of islands is 15 is used, the total discharge amount is 24 g/min and cutting is performed such that the fiber length is 15 mm.

Ultrafine fibers obtained in Example 8 have a fiber diameter of 5000 nm, L/D of 3000, and a carboxyl terminal group amount of 52 eq/ton. A result thereof is shown in Table 2.

In each of Examples 5 to 8, although the fiber diameter of the ultrafine fibers in the fiber dispersion liquid and the solid content concentration are increased, excellent dispersibility is exhibited and the dispersion stability and thixotropy index (TI) are also excellent.

Example 9

Polyethylene terephthalate (PET2) is used as an island component 1, polybutylene terephthalate (PBT, melt viscosity: 160 Pa·s) is used as an island component 2, and copolymerized PET is used as the sea component. A sea-island composite spinneret capable of spinning three components to form 250-island island component having a side-by-side type composite form in one sea-island fiber is used.

A conjugation ratio of island component 1/island component 2/sea component is adjusted by the discharge amount to be 15/15/70 in terms of weight ratio (total discharge amount: 25 g/min). A melted and discharged filament is cooled and solidified, then applied with an oil agent and wound at a spinning speed of 3000 m/min to obtain an undrawn fiber. Further, the undrawn fiber is drawn at a draw ratio of 1.4 times between a roller heated to 80° C. and a roller heated to 130° C. (drawing speed: 800 m/min) to obtain the sea-island fiber.

The sea-island fiber is cut to have a fiber length of 1.2 mm, and then the sea component is removed with a sodium hydroxide aqueous solution, thereby obtaining an ultrafine fiber having a fiber diameter of 300 nm, L/D of 4000, and a carboxyl terminal group amount of 40 eq/ton. Moreover, the ultrafine fiber has a side-by-side type cross-sectional shape, a modification degree of 3.3 and a modification degree variation of 4.7%.

The ultrafine fiber expresses a three-dimensional spiral structure due to the side-by-side structure. Due to an increase in a charge repulsive force caused by an increase in a contact area with the medium, a fiber dispersion liquid (solid content concentration: 0.5 wt %) having good dispersibility and dispersion stability in the medium can be obtained. A result thereof is shown in Table 2.

Example 10

All processes are performed in the same manner as in Example 1 except that the cross-sectional shape of the island component is triangular and the fiber length is 1.2 mm.

Ultrafine fibers obtained in Example 10 have a fiber diameter of 310 nm, L/D of 3488, and a carboxyl terminal group amount of 52 eq/ton. The triangular cross-sectional shape thereof has a modification degree of 2.0 and a modification degree variation of 6.4%. The ultrafine fibers exhibit rigidity and a gloss feeling as compared with the round cross section, and also have favorable dispersibility and dispersion stability in the medium. A result thereof is shown in Table 2.

TABLE 1

| | | | Example 1 | Example 2 | Example 3 | Comparative Example 1 | Example 4 | Comparative Example 2 |
|---|---|---|---|---|---|---|---|---|
| Ultrafine Fiber | Polymer | — | PET 1 | PET 1 | PET 1 | PET 1 | PET 2 | PET 3 |
| | Component | — | Single Component | Single Component | Single Component | Single Component | Single Component | Single Component |
| | Fiber Diameter (D) | nm | 200 | 300 | 300 | 200 | 200 | 200 |
| | Fiber Length (L) | mm | 0.6 | 1.2 | 1.8 | 5.0 | 0.6 | 0.6 |
| | L/D | — | 3000 | 4000 | 6000 | 10000 | 3000 | 3000 |
| | Carboxyl Terminal Group Amount | eq/ton | 52 | 52 | 52 | 52 | 40 | 28 |
| | Cross-sectional Shape | — | Round | Round | Round | Round | Round | Round |
| | Modification Degree | — | 1.0 | 1.0 | 1.0 | 1.0 | 1.0 | 1.0 |
| | Modification Degree Variation | % | 4.9 | 2.7 | 2.7 | 4.9 | 4.9 | 5.2 |
| Fiber Dispersion Liquid | Dispersant | Equivalence Ratio | 0 | 0 | 0 | 0 | 0 | 0 |
| | Solid Content Concentration | wt % | 0.5 | 0.5 | 0.5 | 0.5 | 0.5 | 0.5 |
| | Dispersion Index | — | 10.1 | 13.8 | 17.3 | 35.2 | 12.0 | 22.5 |
| | Dispersion Stability Index | — | 1.00 | 1.00 | 1.00 | 0.36 | 0.72 | 0.60 |
| | Thixotropy Index (TI) | — | 8.5 | 11.7 | 14.3 | 1.1 | 7.2 | 5.1 |

TABLE 2

| | | | Example 5 | Example 6 | Example 7 | Example 8 | Example 9 | Example 10 |
|---|---|---|---|---|---|---|---|---|
| Ultrafine Fiber | Polymer | — | PET 1 | PET 1 | PET 1 | PET 1 | PET 2/PBT | PET 1 |
| | Component | — | Single Component | Single Component | Single Component | Single Component | Two Components | Single Component |
| | Fiber Diameter (D) | nm | 600 | 900 | 1000 | 5000 | 300 | 310 |
| | Fiber Length (L) | mm | 1.8 | 2.7 | 3.0 | 15 | 1.2 | 1.2 |
| | L/D | — | 3000 | 3000 | 3000 | 3000 | 4000 | 3488 |
| | Carboxyl Terminal Group Amount | eq/ton | 52 | 52 | 52 | 52 | 40 | 52 |
| | Cross-sectional Shape | — | Round | Round | Round | Round | Side-By-Side | Triangular |
| | Modification Degree | — | 1.0 | 1.0 | 1.0 | 1.0 | 3.3 | 2.0 |
| | Modification Degree Variation | % | 2.1 | 1.9 | 1.9 | 4.5 | 4.7 | 6.4 |
| Fiber Dispersion Liquid | Dispersant | Equivalence Ratio | 1.0 | 1.0 | 1.0 | 1.0 | 0 | 0 |
| | Solid Content Concentration | wt % | 1.0 | 1.0 | 1.0 | 1.0 | 0.5 | 0.5 |
| | Dispersion Index | — | 14.3 | 15.3 | 17.6 | 18.5 | 13.8 | 10.1 |
| | Dispersion Stability Index | — | 1.00 | 1.00 | 1.00 | 0.87 | 1.00 | 1.00 |
| | Thixotropy Index (TI) | — | 8.5 | 8.5 | 8.5 | 8.5 | 11.7 | 9.9 |

Although our ultrafine fiber and liquid fiber dispersion has been described in detail with reference to a specific example, it will be apparent to those skilled in the art that various changes and modifications can be made without departing from the spirit and scope of the appended claims. This application is based on Japanese Patent Application No. 2018-215287 filed on Nov. 16, 2018, and the contents thereof are incorporated herein by reference.

The invention claimed is:

1. An ultrafine fiber having a fiber diameter (D) of 100 to 5000 nm, a ratio (L/D) of a fiber length (L) to the fiber diameter (D) of 3000 to 6000, and a carboxyl terminal group amount of 40 eq/ton or more, wherein at least a part of a surface layer of the ultrafine fiber is formed of polyester, when the ultrafine fiber is dispersed in an aqueous medium to obtain a fiber dispersion liquid having a solid content concentration of 0.01 to 10% by weight, a dispersion index measured by the following method is 20 or less, method of measuring the dispersion index: a fiber dispersion liquid is prepared such that the solid content concentration is 0.01% by weight with respect to a total amount of the fiber dispersion liquid, an image of the obtained fiber dispersion liquid at a magnification of 50 times is captured with a microscope under transmitted illumination, the image is converted into a monochrome image by using an image processing software, then a luminance histogram is formed with 256 grades, and a standard deviation obtained from the luminance histogram is used as the dispersion index.

2. The ultrafine fiber according to claim 1, comprising a composite fiber formed of at least two kinds of polymers, and has a sheath-core structure or a side-by-side structure.

3. The ultrafine fiber according to claim 1, having a modification degree of 1.1 to 5.0 and a modification degree variation of 1.0% to 10.0%.

4. The ultrafine fiber according to claim 1, formed of polyester.

5. The ultrafine fiber according to claim 1, formed of polyester, and has a modification degree of 1.1 to 5.0 and a modification degree variation of 1.0% to 10.0%.

6. A method of manufacturing a fiber product comprising forming the ultrafine fiber according to claim 1 into the fiber product.

* * * * *